US008684137B2

(12) United States Patent
Collister et al.

(10) Patent No.: US 8,684,137 B2
(45) Date of Patent: Apr. 1, 2014

(54) ROOF JACK APPARATUS

(75) Inventors: Kenneth F. Collister, North Branch, MI (US); Brenden J. Jones, Rochester Hills, MI (US)

(73) Assignee: Kenneth F. Collister

( * ) Notice: Subject to any disclaimer, the term of this patent is extended or adjusted under 35 U.S.C. 154(b) by 441 days.

(21) Appl. No.: 13/007,128

(22) Filed: Jan. 14, 2011

(65) Prior Publication Data

US 2011/0174574 A1 Jul. 21, 2011

Related U.S. Application Data

(60) Provisional application No. 61/295,277, filed on Jan. 15, 2010.

(51) Int. Cl.
*E04G 3/26* (2006.01)

(52) U.S. Cl.
USPC ..... 182/45; 248/237

(58) Field of Classification Search
USPC ..... 182/45; 248/237
See application file for complete search history.

(56) References Cited

U.S. PATENT DOCUMENTS

| | | | | | |
|---|---|---|---|---|---|
| 2,231,560 | A | * | 2/1941 | Campion | 105/157.1 |
| 2,329,415 | A | * | 9/1943 | Osborne | 248/237 |
| 3,292,734 | A | * | 12/1966 | Swanberg | 182/45 |
| 3,526,296 | A | * | 9/1970 | Stevens | 182/45 |
| 4,078,633 | A | * | 3/1978 | Fahy | 182/82 |
| 5,192,059 | A | * | 3/1993 | Silver | 269/41 |
| 5,318,148 | A | * | 6/1994 | Franco et al. | 182/45 |
| D373,718 | S | * | 9/1996 | Rondeau | D8/349 |
| 5,758,743 | A | * | 6/1998 | Coyle et al. | 182/45 |
| 5,896,944 | A | * | 4/1999 | McMillian et al. | 182/45 |
| 5,908,083 | A | * | 6/1999 | Hamilton | 182/45 |
| 6,003,629 | A | * | 12/1999 | Cloutier et al. | 182/45 |
| 6,527,265 | B1 | * | 3/2003 | Goodding | 269/69 |
| 7,028,990 | B2 | * | 4/2006 | Shorey et al. | 256/1 |
| 7,354,025 | B2 | * | 4/2008 | Searle | 248/237 |
| 8,186,479 | B2 | * | 5/2012 | Vieira | 182/45 |
| 2001/0013205 | A1 | * | 8/2001 | Goodding | 52/127.2 |
| 2002/0153200 | A1 | * | 10/2002 | Bryant | 182/45 |
| 2004/0129847 | A1 | * | 7/2004 | Searle | 248/237 |
| 2005/0247518 | A1 | * | 11/2005 | Klein et al. | 182/45 |
| 2006/0180391 | A1 | * | 8/2006 | Thomas et al. | 182/45 |
| 2006/0237263 | A1 | * | 10/2006 | Gaines | 182/113 |
| 2007/0062761 | A1 | * | 3/2007 | Megna et al. | 182/45 |
| 2008/0006481 | A1 | * | 1/2008 | Vieira | 182/45 |

FOREIGN PATENT DOCUMENTS

| | | | | |
|---|---|---|---|---|
| DE | 3709441 | A1 | * | 10/1988 |
| DE | 4135738 | A1 | * | 5/1993 |
| GB | 2201716 | A | * | 9/1988 |

* cited by examiner

*Primary Examiner* — Charles A Fox
*Assistant Examiner* — Candace L Bradford
(74) *Attorney, Agent, or Firm* — Honigman Miller Schwartz and Cohn LLP

(57) ABSTRACT

A roof jack apparatus that includes a rail having first and second end portions and a slide connector slidably received by the rail and capable of being fixed at a position along the rail. The slide connector is configured to releasably receive a jack support for at least partially supporting the rail above a roof. The roof jack apparatus also includes a fascia rest disposed on the second end portion of the rail for resting against a fascia of the roof. The slide connector can move along the rail with respect to the fascia rest. A plank support disposed on the second end portion of the rail can receive and support at least one plank.

24 Claims, 9 Drawing Sheets

ROOF JACK APPARATUS

CROSS REFERENCE TO RELATED APPLICATIONS

This U.S. patent application claims priority under 35 U.S.C. §119(e) to U.S. Provisional Application 61/295,277, filed on Jan. 15, 2010, which is hereby incorporated by reference in its entirety.

TECHNICAL FIELD

This disclosure relates to roof brackets and scaffolding.

BACKGROUND

Roofers routinely use scaffolding, ladder jacks, and ladders to begin roofing steep sloped roofs. Setting up the above mentioned equipment is time consuming, dangerous and repetitive. The old process involves setting up and tearing down equipment multiple times for roof tear off and installation. A further drawback to the old methodology is damaged gutters, and gutters filled with debris. This old process is also dangerous and involves multiple laborers.

SUMMARY

One aspect of the disclosure provides a roof jack assembly that includes a raised rail, which can be nailed to a roof at its upper extended position through a nailing fin. A lower portion of the roof jack rests against a fascia of the roof and can be held up by a fascia support. Like the upper portion of the raised rail, an intermediary portion of the raised rail includes a slide connector that enables roof jacks to be attached or removed. The slide connectors allow the roof jacks to be installed along the raised rail incrementally. The multiplicity of roof jacks allows for interchangeability, which allows workers a clear work area in alternate positions, where the rail roof jack is not installed. This allows roofers to install materials under the raised rail and remove materials under the raised rail. Additionally, the secured roof jack can hold planks for support and materials for storage.

Implementations of the disclosure may include one or more of the following features. In some implementations, the roof jack assembly includes vertical and horizontal adjustments for differing scaffolding board widths and roof pitch variations. The lower portion of the roof jack may include a lower frame angle support, which connects the fascia support to the lower raised rail. An adjustable plank support connecting to the frame angle support allows the roofers to work off the roof, leaving a clear area to install drip edge, ice shield, tar paper, wood and other materials. This also allows roofers to remove materials. A lower portion of the roof jack, being supported at the fascia, also allows the plank to rest above or away from the gutters which protect them, and acts as a resting place for the ladders, without resting on the gutters. Working off the roof, on the roof jack assembly, alleviates the need to start work with scaffolding or ladder jacks. The roof jack assembly makes roofing demolition and installations easier and faster because the workers do not have to tear down and set up if they are tearing off and installing materials. Contractors benefit from time savings and the safety afforded by the roof jack assembly. Home owners benefit from the protection afforded by the roof jack assembly for their gutters and landscape against damage from falling debris and from ladders leaning on gutters.

Another aspect of the disclosure provides a roof jack apparatus that includes a rail having first and second end portions and a slide connector slidably received by the rail and capable of being fixed at a position along the rail. The slide connector is configured to releasably receive a jack support for at least partially supporting the rail above a roof. The roof jack apparatus also includes a fascia rest disposed on the second end portion of the rail for resting against a fascia of the roof. The slide connector can move along the rail with respect to the fascia rest. A plank support disposed on the second end portion of the rail can receive and support at least one plank.

In some implementations, the roof jack apparatus includes a slide stop having a slide stop body defining a rail receiver therethrough for receiving the rail and a peg hole therethrough for receiving a peg. The peg hole is alignable with a corresponding hole defined by the rail for receiving a peg in the aligned peg and rail holes to lock a position of the slide stop on the rail. The locked slide stop limits travel of the slide connector along the rail. The slide stop may include a standoff adjuster disposed on the slide stop body for adjusting an offset distance between the slide stop body and the abutting slide connector on the rail. In some examples, the standoff adjuster includes a set screw threadably received by the slide stop body.

The slide connector, in some implementations, include a connector body defining a rail receiver for receiving the rail therethrough and a jack support receiver for releasably receiving an arm of the jack support. A handle can be pivotally coupled to the connector body. The handle has one end biased to engage the rail such that friction between the biased handle end and the rail impedes movement of the slide connector along the rail.

In some implementations, the jack frame includes a jack frame body having first and second ends. The first end defines at least one nail receiver for receiving a nail to secure the support frame to a roof. The second end is configured for receipt by the slide connector. The jack frame body may define a plank support surface between the first and second ends to support a received plank at an angle with respect to an attached roof.

The fascia rest may include at least one extendable leg extending for engaging the roof fascia. The roof jack apparatus may include a frame support disposed on the second end portion of the rail and a plank support receiver disposed on the second end portion of the rail. A first end portion of the plank support is rotatably coupled to the frame support and a second end portion of the plank support is received by the plank support receiver, the plank support receiver limiting a range of rotation of the plank support. The plank support receiver may define an array of holes which can receive a peg to set a rotation limit of the plank support.

The roof jack apparatus may include a railing support receiver disposed on the second end portion of the rail and defining a receptacle configured to receive a railing support. Moreover, the roof jack apparatus may include a plank fastener arranged near the plank support for holding one or more planks against the plank support. An outrigger can be attached to the plank support for supporting multiple planks.

In yet another aspect, a roof jack apparatus includes a rail and a slide stop slidably disposed on the rail. The slide stop is fixedly positionable along the rail. The roof jack apparatus includes also includes a slide connector slidably disposed on the rail. The slide stop limits travel of the slide connector along the rail when fixedly positioned on the rail. A jack frame attachable to a roof can be releasably received by the slide connector to support the rail above the roof. The roof jack apparatus includes a support frame connected to the rail. The support frame includes a frame support connected to the rail, a fascia rest connected to the frame support, and a plank support connected to the frame support and the rail.

Implementations of the disclosure may include one or more of the following features. In some implementations, the slide stop includes a slide stop body defining a rail receiver therethrough for receiving the rail and a peg hole therethrough for receiving a peg. The peg hole is alignable with a corresponding hole defined by the rail for receiving a peg in the aligned peg and rail holes to lock a position of the slide stop on the rail. The slide stop may include a slide stop body and a standoff adjuster disposed on the slide stop body for adjusting an offset distance between the slide stop body and the abutting slide connector on the rail. In some examples, the standoff adjuster includes a set screw threadably received by the slide stop body.

The slide connector may include a connector body defining a rail receiver for receiving the rail therethrough and a jack support receiver for releasably receiving an arm of the jack support. The slide connector may have a handle pivotally coupled to the connector body. The handle has one end biased to engage the rail such that friction between the biased handle end and the rail impedes movement of the slide connector along the rail.

In some implementations, the jack frame includes a jack frame body having first and second ends. The first end defines at least one nail receiver for receiving a nail to secure the support frame to a roof. The second end is configured to be received by the slide connector. In some examples, the jack frame body defines a plank support surface between the first and second ends to support a received plank at an angle with respect to an attached roof.

The fascia rest may include at least one extendable leg extending at an angle with respect to the frame support for engaging a roof fascia. The plank support may have a first end portion rotatably coupled to the frame support and a second end portion received by a plank support receiver attached to the rail. The plank support receiver limits a range of rotation of the plank support. In some examples, the plank support receiver defines an array of holes which can receive a peg to set a rotation limit of the plank support. The support frame may include a railing support receiver defining a receptacle configured to receive a railing support (e.g., for supporting a safety railing). Moreover, the support frame may include a plank fastener for holding one or more planks against the plank support.

Another aspect of the disclosure provides a method of using a roof jack apparatus. The method includes attaching a jack support to a roof, connecting a slide connector slidably disposed on a rail of the roof jack apparatus to the jack support, moving the rail with respect to the slide connector to engage a fascia rest of the roof jack apparatus against a roof fascia, and locking a position of the slide connector on the rail.

In some implementations, the method includes sliding the rail through a rail receiver defined by the slide connector to move the rail relative to the slide connector. The method may also include fixedly positioning a slide stop on the rail to limit travel of the slide connector along the rail. In some examples, the method includes sliding the rail through a rail receiver defined by the slide stop to align a hole defined by the slide stop with a hole defined by the rail and placing a peg through the aligned holes. A user may adjust an offset distance between the slide stop and the slide connector. The method may include placing a plank on the jack support and/or adjusting a pitch of a plank support of a support frame disposed at a lower end of the rail. The method may include placing a plank on the plank support, the plank support supporting the plank off and away from the roof.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
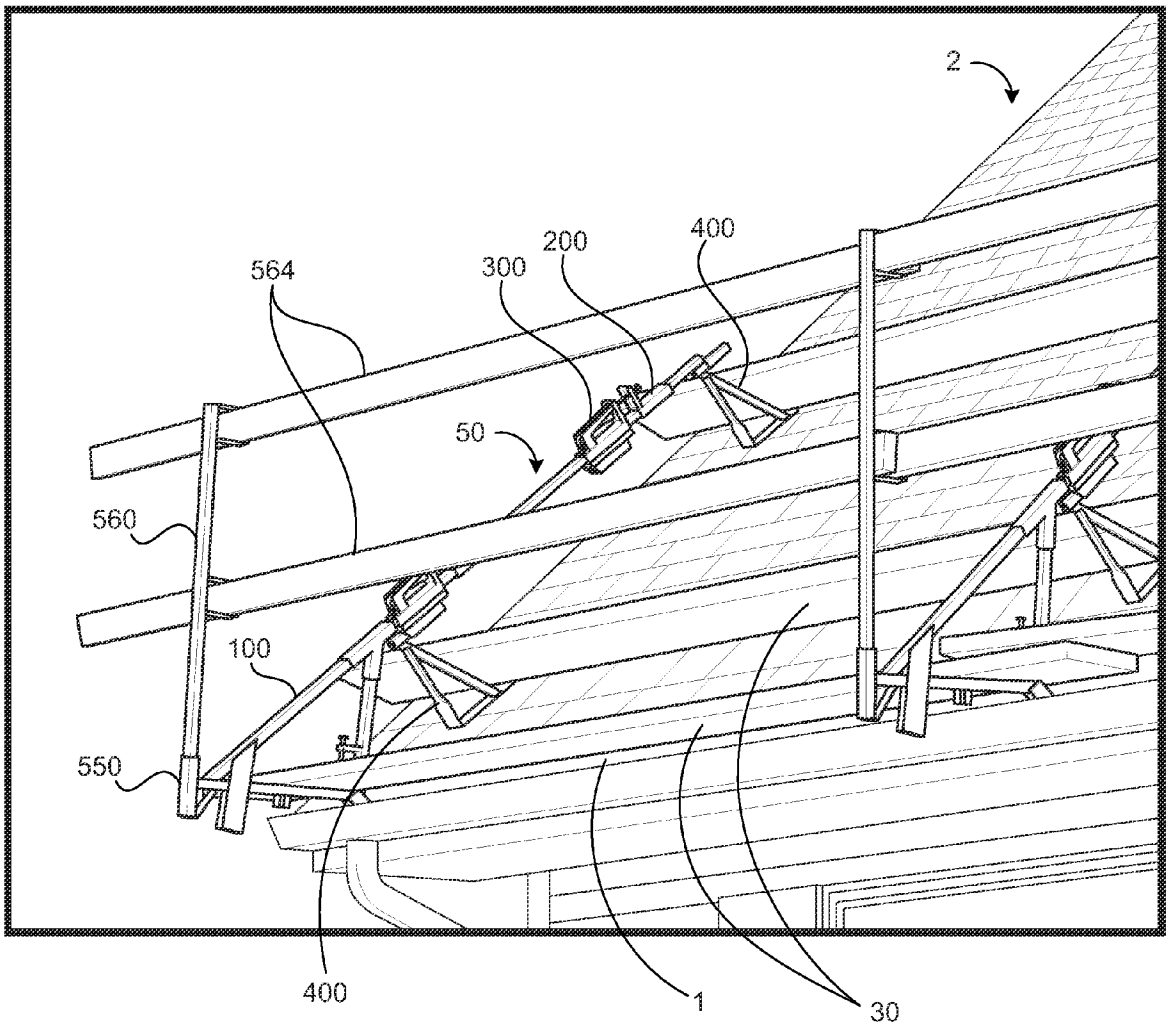
FIG. 1 is a perspective view of an exemplary roof jack apparatus installed on a roof.

Referring to FIGS. 1-6, a roof jack apparatus 50 can be installed on a roof 2 to provide a support structure for a worker (e.g., a roofer or contractor) to stand on while conducting work on the roof 2. Multiple roof jack apparatuses 50 installed substantially parallel and substantially level with each on the roof 2 can receive one or more support planks 30 which allow the worker to stand above or even off and away from the roof 2 (depending on the location of the roof jack apparatuses 100 on the roof).

Figure 2:
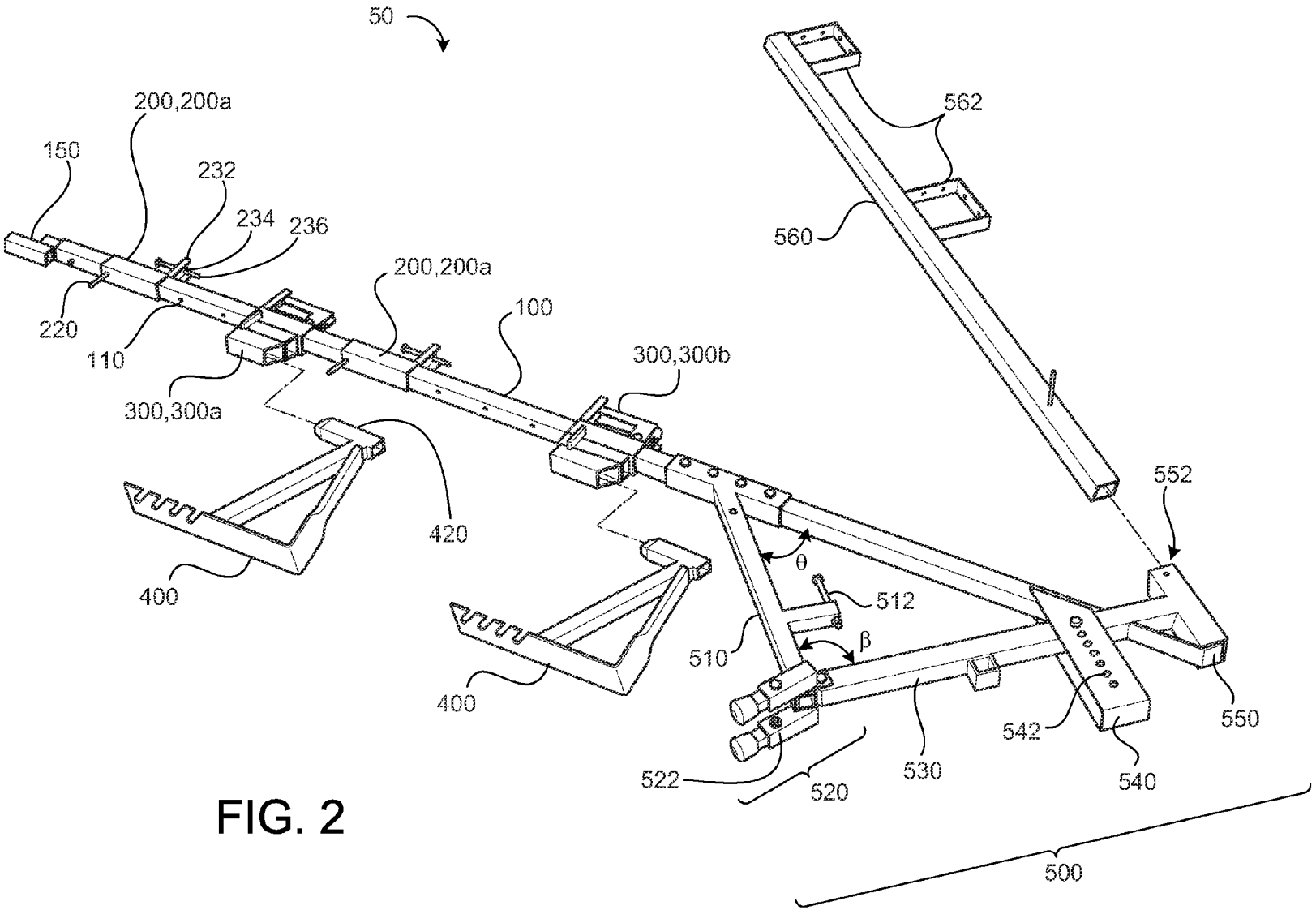
FIG. 2 is a perspective view of an exemplary roof jack apparatus.
Figure 4:
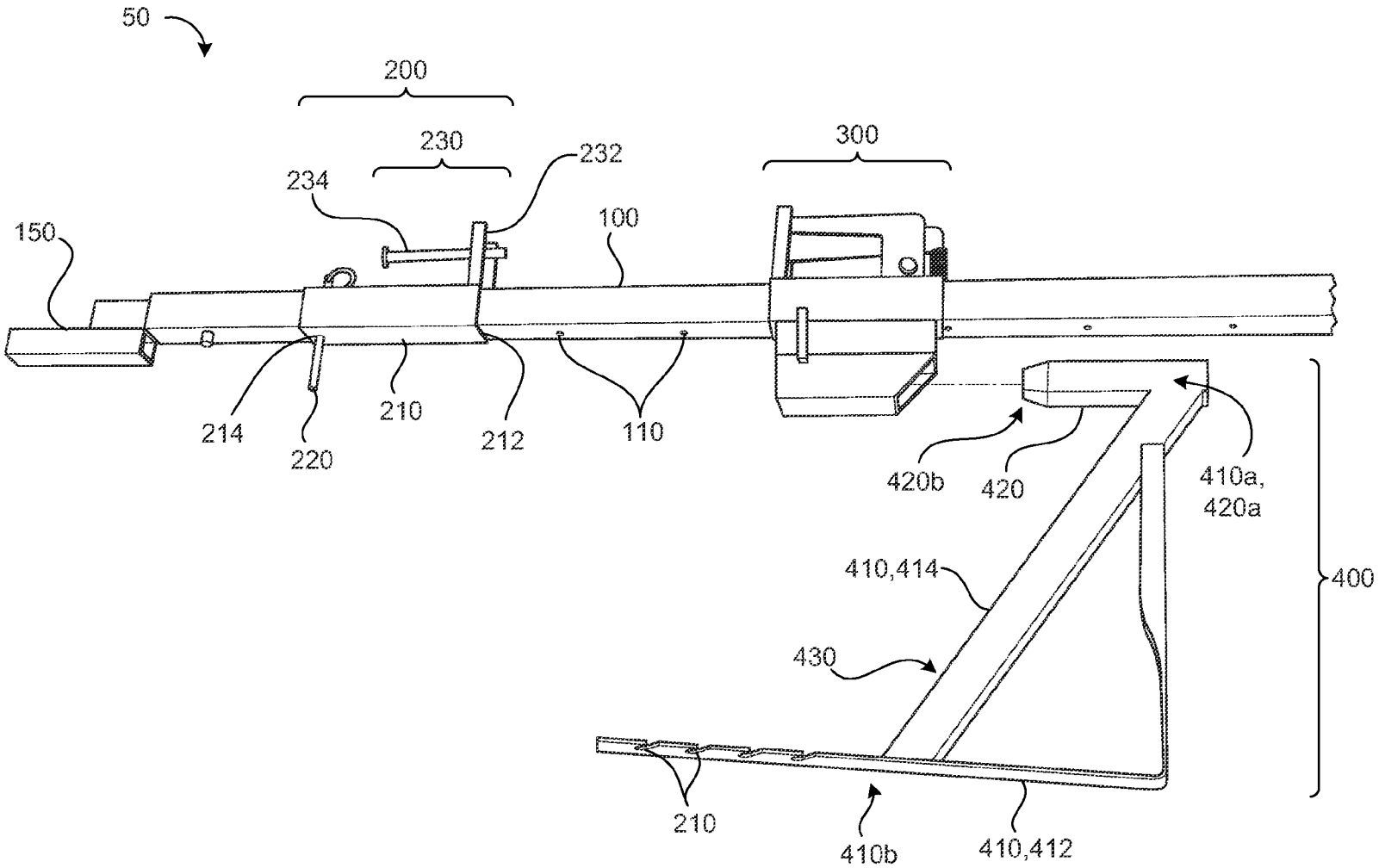
FIG. 4 is a side perspective view of a plank holder of a roof jack apparatus.

The roof jack apparatus 50 includes a rail or strut 110 (e.g., box beam) having one or more slide stops 200 and one or more slide connectors 200 all slidably disposed on the rail 100. Referring to FIGS. 2 and 4, in some implementations, each slide stop 200 may have a slide stop body 210 that defines a rail receiver 212 therethrough. The slide stop 200 slidably receives the rail 100 through the rail receiver 212 to slide along the rail 100. Each slide stop 200 can be locked in a position along the rail 100 to limit the travel of an adjacent slide connector 200 along the rail 100. In the examples shown, the rail 100 defines an array of holes 110 each of which can line up with a peg hole 214 defined by the slide stop body 210. A user can place a peg 220 of the slide stop 200 through a lined up peg hole 214 and rail hole 110 to secure the slide stop 200 in a position with respect to the used rail hole 110. The slide stop 200 may include standoff adjuster 230, which allows the user to adjust an offset distance between the slide stop 200 and a slide connector 300. In the example shown, the standoff adjuster 230 includes a standoff support 232 disposed on the slide stop body 210 and defining a threaded hole 234 for receiving a threaded bolt 236. The user may thread the bolt 236 through the threaded hole 234 to adjust the offset distance. The bolt 236 receives and limits the travel of the slide connector 300.

In the examples shown, the roof jack apparatus 100 includes first and second slide stops 200*a*, 200*b* for limiting the travel of first and second slide connectors 300*a*, 300*b*, which can move independently with respect to each other along the rail 100. Additional slide stops 200 and slide connectors 300 can be disposed on the rail 100 as well. Moreover, only one slide stop 200 and one slide connector 300 can be disposed on the rail 100.

Figure 3:
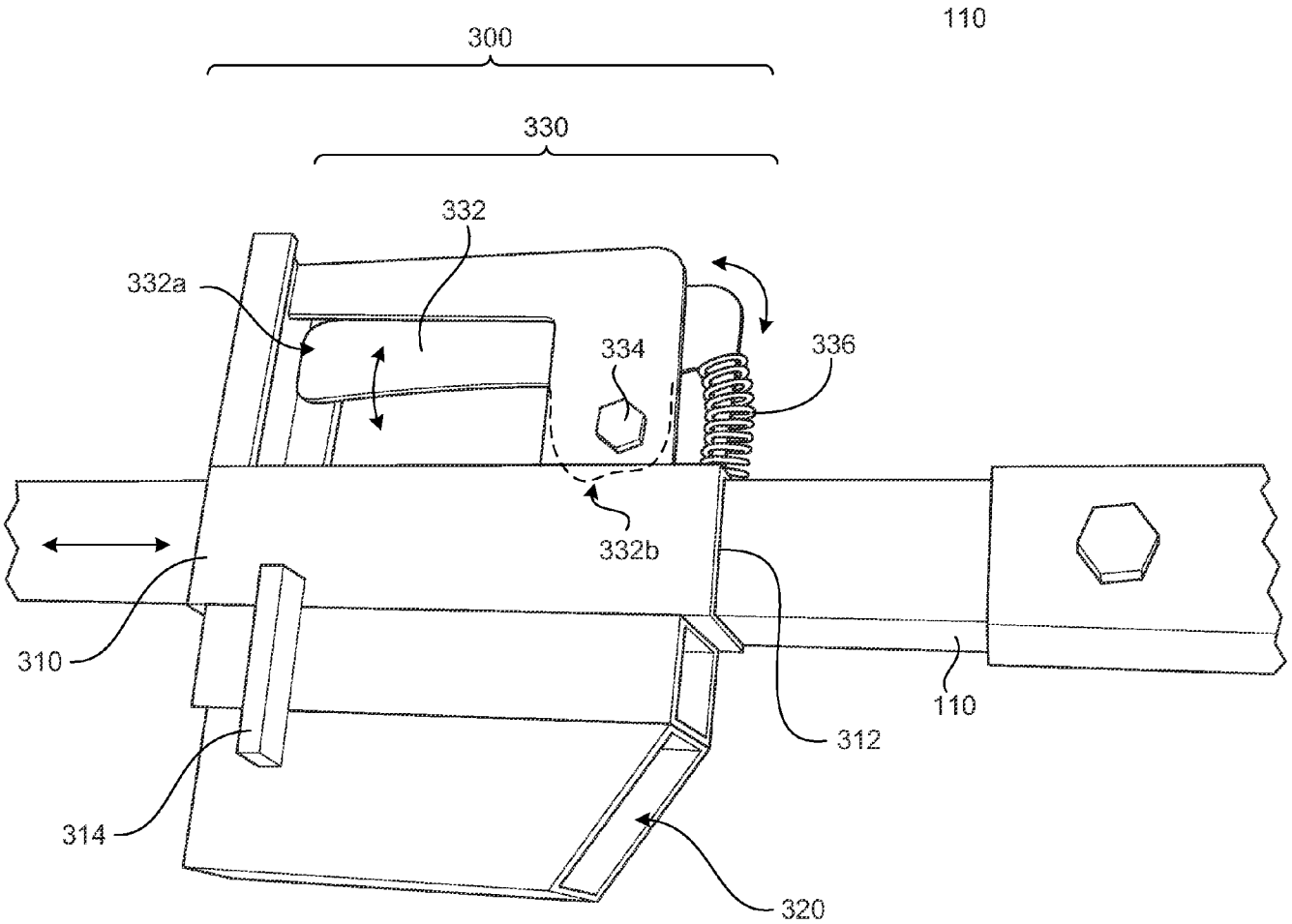
FIG. 3 is a perspective view of a portion of the roof jack apparatus shown in FIG. 2.

Referring to FIGS. 3 and 4, in some implementations, each slide connector 300 has a connector body 310 that defines a rail receiver 312 therethrough. The slide connector 300 slidably receives the rail 100 through the rail receiver 312. Each slide connector 300 can receive a jack frame 400 to support the rail 100 above the roof 2. The connector body 310 defines a jack frame receiver 320 (e.g., an aperture or receptacle) configured to receive and be supported by the jack frame 400. In the examples shown, the rail receiver 312 and the jack frame receiver 320 each define a substantially square cross-sectional shape (e.g., hollow box struts); however, other cross-sectional shapes are possible as well, such as circular or polygonal. While the rail receiver 312 can be sized to allow free movement of the rail 100 therethrough, the jack frame receiver 320 can be sized to provide a snug or relatively tight fit for the received jack frame 400. The slide connector 300 may include a wing 314 disposed on the connector body 310, which allows a user to knock the connector loose from a received jack frame 400 (e.g., using a hammer). The slide connector 300 also includes a friction stop 330 to hold the slide connector 300 in place on the rail 100 while unloaded by a jack frame 400. The friction stop 330 may include a handle 332 that rotates about a pivot 334 disposed on the connector body 310. The handle 332 includes a first end 332*a* graspable by the user and a second end 332*b* arranged to engage the rail 100. Moreover, a spring 336 may bias the handle 332 to engage the second end 332*b* against the rail 100.

The jack frame 400 includes a support body 410 having first and second ends 410*a*, 410*b*. The first end 410*a* of the support body 410 includes an arm 420 sized to be received by the jack frame receiver 320 of a slide connector 300. The arm 420 may have a cross-sectional shape substantially similar to that of the jack frame receiver 320 (e.g., substantially square to prevent rotation). Moreover, the arm 420 may have a first end 420*a* attached to the first end 410*a* of the support body 410 and a distal free, second end 420*b* that receives the slide connector 300. The second arm end 420*b* may define a conical, pyramidal, or frustoconical shape (e.g., to facilitate insertion into the jack frame receiver 320 of a slide connector 300). The second end 410*b* of the support body 410 defines one or more nail receivers 412 (e.g., holes, slots, slits, etc.) for receiving one or more nails to secure the jack frame 400 to the roof 2 (e.g., by nailing the jack frame 400 onto a roof truss). The support body 410 may include a plank support surface 430 to support a plank 30 at an angle with respect to the roof 2 (e.g., an angle that supports the plank 30 substantially level for a user to stand on while working). In some examples, the support body 410 includes an angle bracket 412 reinforced with a gusset or cross-strut 414 between both legs of the angle bracket 412. The cross strut 414 may provide the plank support surface 430. The arm 420 may limit movement of a received plank 30 on the plank support surface 430 (e.g., preventing the plank 30 from sliding off and away from the roof 2).

Figure 5:
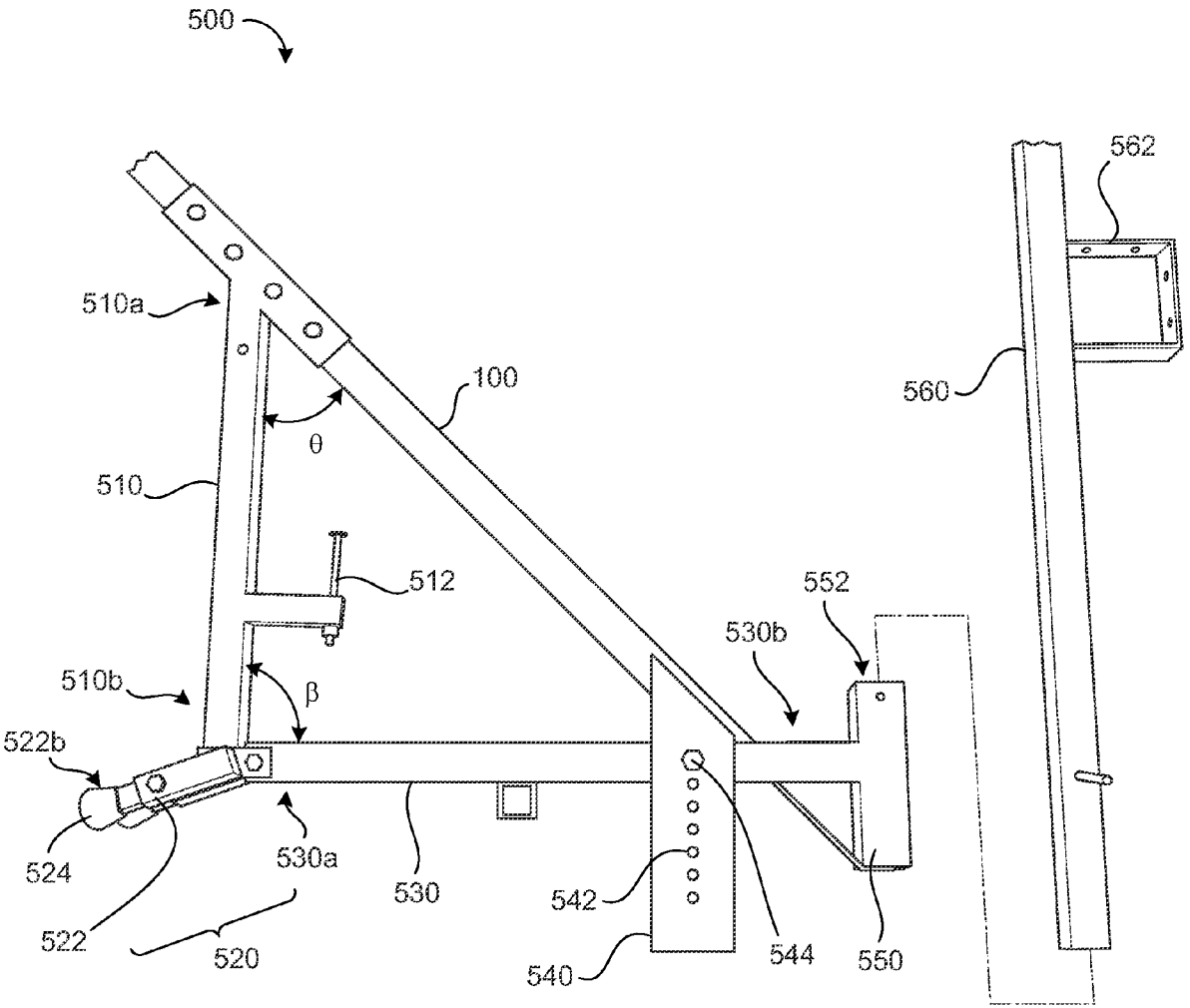
FIG. 5 is a side perspective view of a fascia rest of a roof jack apparatus.
Figure 6:
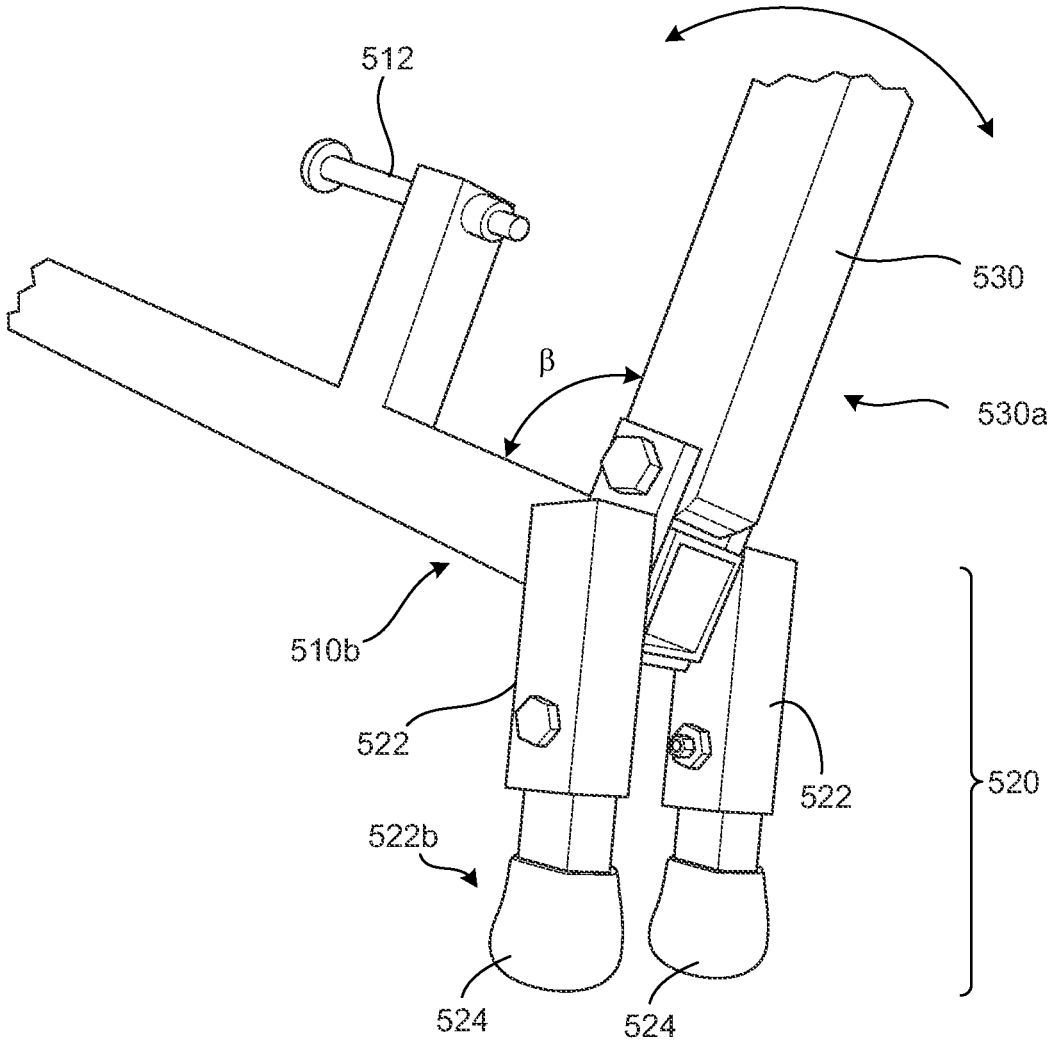
FIG. 6 is a side perspective view of a slide connector of a roof jack apparatus.
Figure 7:
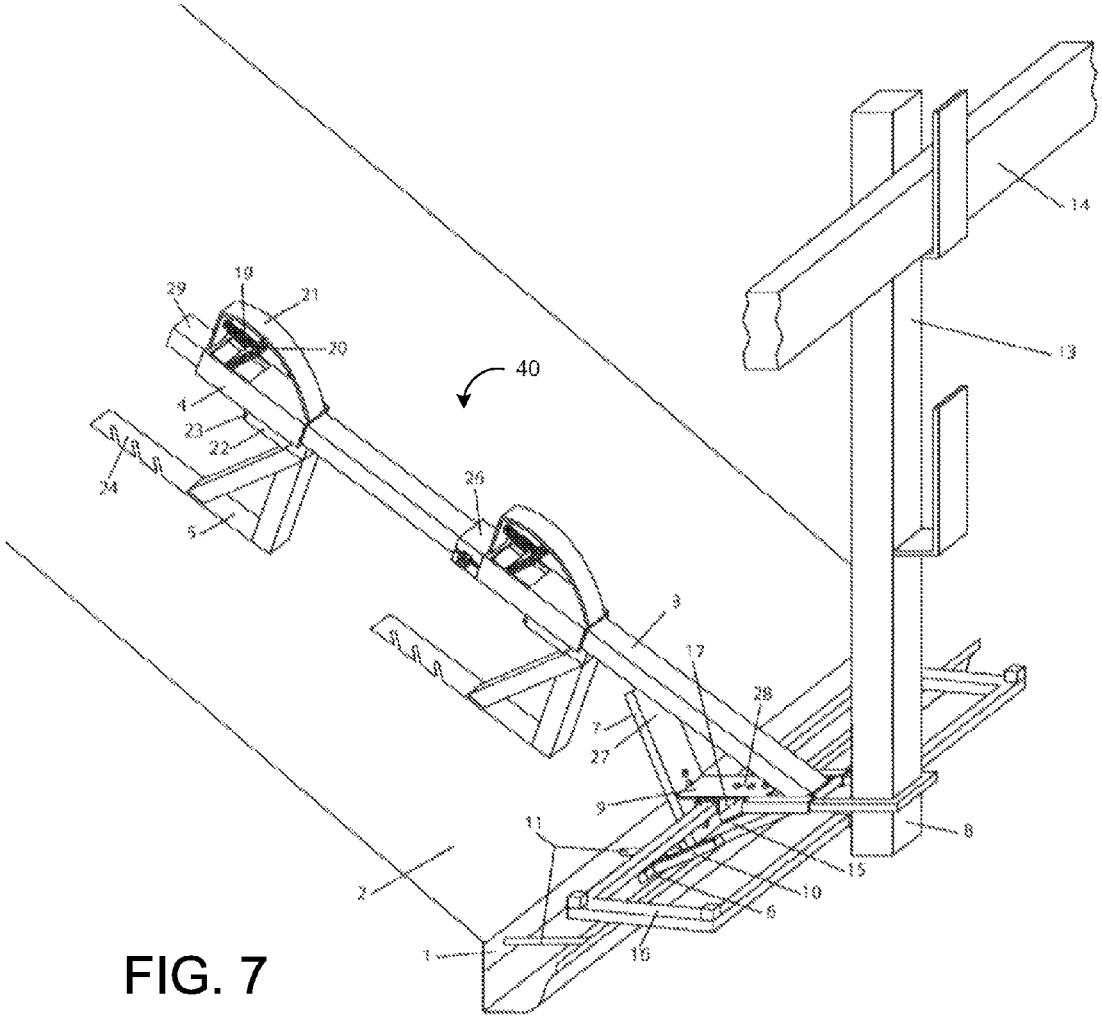
FIG. 7 is a perspective view of an exemplary roof jack assembly installed on a roof.
Figure 8:
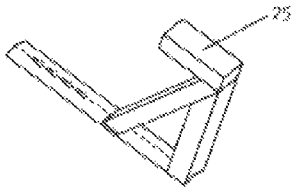
FIG. 8 is a perspective view of an exemplary roof jack.
Figure 9:
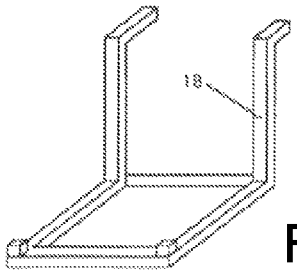
FIG. 9 is a perspective view of an exemplary removable lower plank support.
Figure 10:
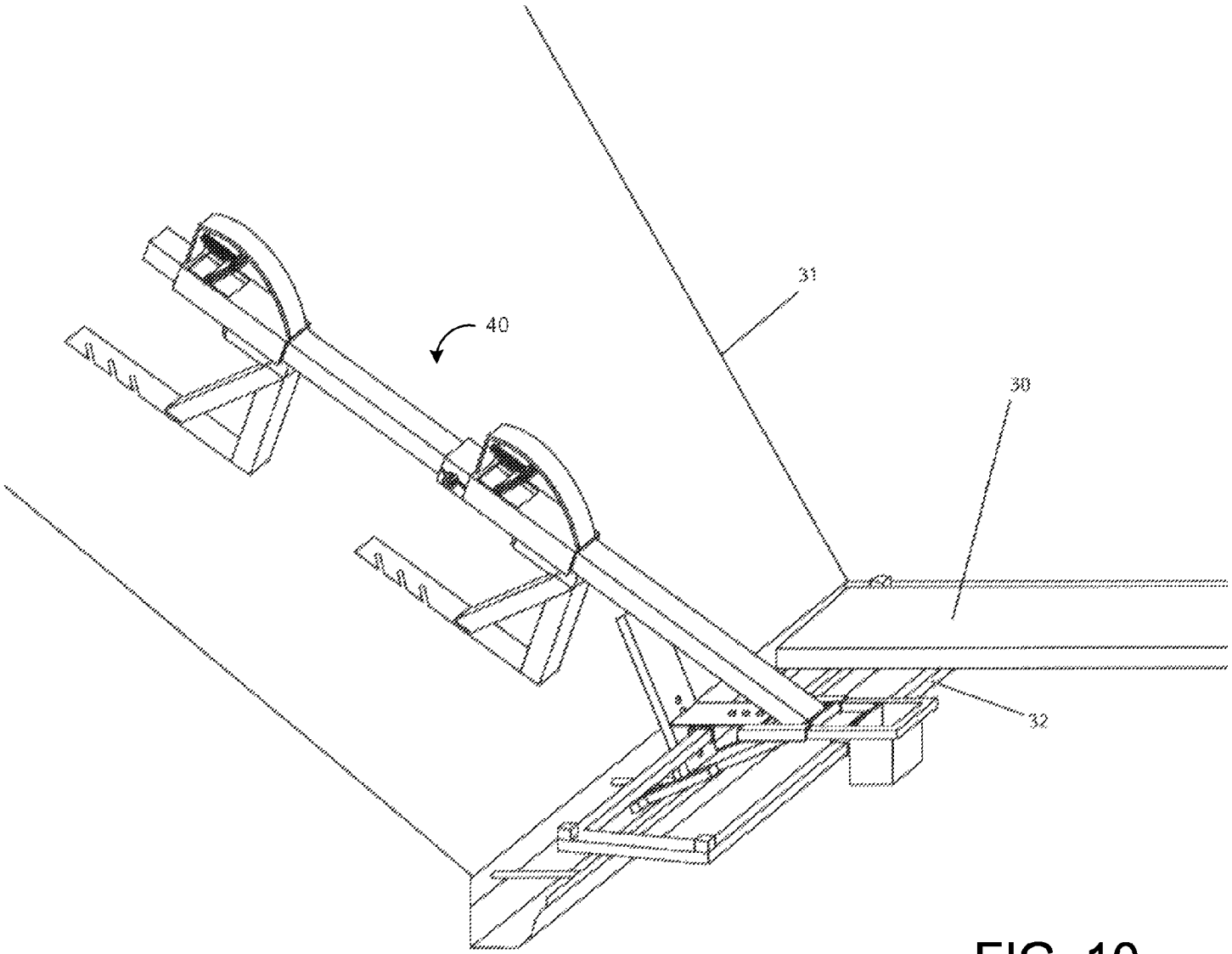
FIG. 10 is a perspective view of an exemplary outrigger for a roof valley installation.
Figure 11:
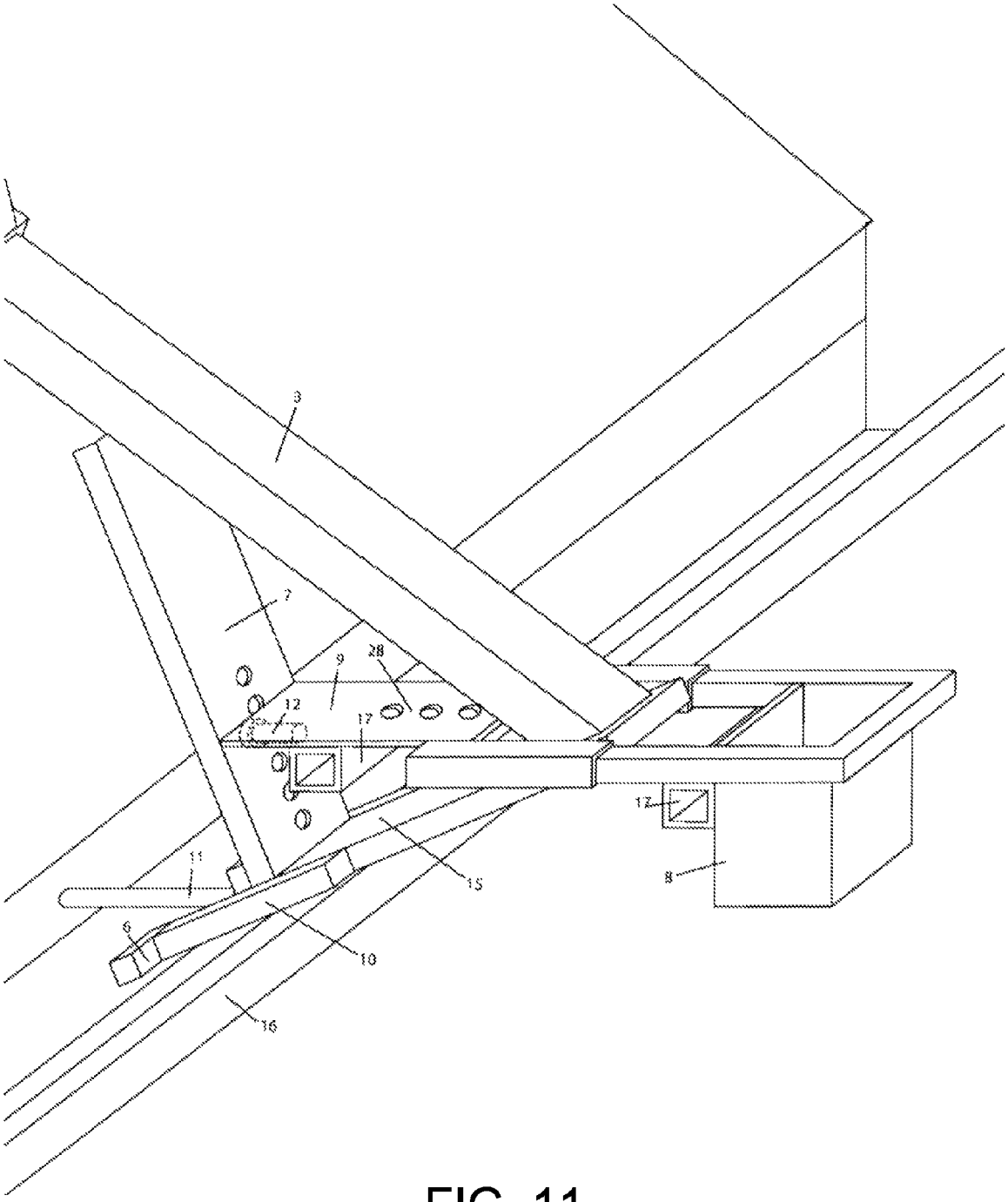
FIG. 11 is a close-up perspective view of the roof jack apparatus shown in FIG. 10 installed on a roof.

Referring to FIGS. 5 and 6, in some implementations, the roof jack apparatus 50 includes a frame 500 connected to a first end 100*a* of the rail 100. A jack connector 150 may be received by the second end 100*b* of the rail 100 for receiving a jack frame 400 (e.g., to supported plank 30 and/or to connect another roof jack apparatus 50 in series). The frame 500 includes a frame support 510 having a first end 510*a* connected to the rail 100 and extending at an angle θ of between about 30° and about 90° with respect to the rail 100 to a second end 510*b* (e.g., an angle θ of about 45° can provide an arrangement for installation on many types of roofs 2). A fascia rest 520 is disposed at the second end 510*b* of the frame support 510. The fascia rest 520 may be arranged at an angle with respect to the frame support 510 to engage the roof fascia 1. The fascia rest 520 is configured to rest against the fascia of the roof 2, supporting the roof jack apparatus 50 and allowing the roof jack apparatus to extend beyond and away from the roof 2. The fascia rest 520 may include at least one extendable leg 522 having an optional rubber stopper or pad 524 disposed on a distal end 522*b* of the at least one leg 522 (e.g., so as not to mark or scratch the fascia 1). The extendable leg 522 can be adjusted to accommodate different types of roof fascia 1. In some implementations, the fascia rest 520 can rotate with respect to the frame support 510 (e.g. to accommodate different styles of roof lines). During installation of the roof jack apparatus 50 on the roof 2, the fascia rest 520 can be positioned on the fascia 1 below any drip edge or a drip edge area, so as not to damage an existing drip edge and/or to allow removal and replacement of an existing drip edge. By having the fascia rest 520 approach and rest on the fascia 1 from an angle with respect to the roof fascia 1, the fascia rest can avoid the drip edge, while providing support to the roof jack apparatus 50. A variable pitch plank support 530 has a first end 530*a* rotatably connected to the second end 510*b* of the frame support 510 and a second end 530*b* received by a plank support receiver 540 connected to the rail 100. The plank support receiver 540 allows the plank support 530 to rotate about its first end 530*a* within a fixed range of motion. For example, the plank support 530 may rotate at an angle β with respect to the frame support 510 of between about 90° and about 150° (e.g., to accommodate roof pitches of between 6/12 and 12/12). In the example shown, the plank support receiver 540 defines an array of holes 542 that may receive a bolt 544 that limits the rotation of the plank support 530 and/or secures the plank support 530 to the plank support receiver 540. The frame 500 may include a railing support receiver 550 disposed on the second end 530*b* of the plank support 530. The railing support receiver 550 defines a receptacle 552 configured to receive a railing support 560. The railing support 560 may define one or more railing receivers 562 (e.g., holes, brackets, support surfaces, etc.) that can receive a railing 564 (e.g., a 2×4 piece of wood). When multiple roof jack apparatuses 50 are installed on a roof 2 substantially parallel to each other, planks 30 and railings 564 can be supported therebetween. The plank support 530 and/or the frame support 510 may include a plank fastener 512 (e.g., a set screw or linkage) that secures overlapping received planks 30 in place. For example, the plank fastener 512 can press the planks 30 against the plank support 530 to secure their position thereon.

A method of using the roof jack apparatus 50 may include attaching a jack support 400 to a roof 2, connecting the slide connector 300, which is slidably disposed on the rail 100, to the jack support 400, moving the rail 100 with respect to the slide connector 300 to engage the fascia rest 520 against a roof fascia 1, and locking a position of the slide connector 300 on the rail 100.

In some implementations, the user slides the rail 100 through the rail receiver 312 defined by the slide connector 300 to move the rail 100 relative to the slide connector 300.

The user may fixedly position a slide stop 200 on the rail 100 to limit travel of the slide connector 300 along the rail 100. In some examples, the user slides the rail 100 through the rail receiver 212 defined by the slide stop 200 to align a hole 214 defined by the slide stop 200 with a hole 110 defined by the rail 100 and then places a peg 220 through the aligned holes 110, 214. The user may adjust an offset distance between the slide stop 200 and the slide connector 300, for example, by adjusting a set screw 234 on the slide stop 200. The user may place a plank 30 on the jack support 400. The plank 30 may be supported by another adjacent roof jack apparatus 50. In some examples, the user adjusts a pitch of the plank support 530 to move a received plank 30 to a desired position, such as a level position. The user can place one or more planks 30 on the plank support 530 and optionally secure or hold the planks 30 on the plank support 530 by engaging the plank fastener 512. The plank support supports the received plank(s) 30 off and away from the roof 2.

Referring to FIGS. 7-11, in some implementations, a frame 40 rests against the fascia 1 of a roof 2 and extends up over a portion of the roof 2. An upper section of the frame 40 holds a raised rail 3, which holds at least one slide connector 4. The slide connector 4 can also be attached to a rail roof jack 5, which is nailed to the roof 2. Like the upper section of the frame 40, the remaining portion of the frame 40 extending up over the roof 2 contains a slide connector 4, which attaches to the raised rail 3. The lower portion of the frame 40 rests on the fascia 1, by means of a fascia support with a pad 6. An frame angle support 7 holds the frame angle pin 12 which secures an adjustable plank support 9. The adjustable plank support 9 attaches to a safety post holder 8, which adjusts vertically to account for pitch changes. A horizontal adjustment bar 28 accommodates different board widths. The fascia support 6 may be supported by a dual post 10 to account for fascia corners due to hip ridges and to avert gutter support brackets 11. A frame angle support 7 connects to the adjustable plank support 9 which connects to the raised rail 3. The adjustable plank support 9, the frame angle support 7 and the lower raised rail hold a safety post holder 8 that holds a safety post 13, which holds a safety rail 14. The adjustable plank support base 15 braces the adjustable plank support 9 which holds a removable outrigger 16 that is supported by adjustable outrigger plank support receptors 17. This allows a worker a clear a path while working up valleys 31. It also allows plank support on either side of the jack's main structure so planks 30 don't need to be overlapped. Instead they can set next to each other on the same level. The adjustable outrigger plank support receptors 17 can also hold the removable lower plank support 18 (shown in figure C), which allows workers to work below the level of the gutter. This will alleviate the need to bend over and work below the level of the plank.

The slide connectors 4 may operate by sliding along the raised rail 3. This allows a worker to set the jacks 5 at any location along the raised rail 3. A spring loaded wedge tabs 19 of slide connector 4 surrounds, presses against or otherwise engages the raised rail 3 and locks the slide connector 4 into place, by releasing the incremental slide release lever 20. The incremental slide release lever 20 can be protected by a slide lever guard 21. The wedge tabs 19 can fit into notches defined by the raised rail 3. The slide connector 4 holds a rail jack receiver 22, which slides over the top of the tapered end 23 of the rail roof jack 5. The rail roof jacks 5 are nailed to the roof through a nailing fin 24, independent of the raised rail 3 and slide connector 4. The nailing fin 24 may be tapered 25 (as shown in figure B) toward its center if it is to be attached at the hip of a roof 2.

A slide connector 4 can be removed from the rail roof jack 5, while another one remains attached to a rail roof jack by releasing the incremental slide release lever 20 and pushing the slide connector 4 up.

If a worker is tearing off roofing he may set a rail roof jack 5 in the lower portion of the raised rail 3. The worker could then hook the slide connector 4 to the rail roof jack receiver 22 and over the top of the roof rail jack's tapered end 23. The worker would settle the fascia support 6 to the fascia 1, by engaging the incremental slide release lever 20, and pushing in the frame angle support 7 up the roof 2. Once the fascia support 6 is against the fascia 1, the worker can let go of the incremental slide release lever 20 and slide the safety clamp 26 against the slide connector and tighten its screw. This prevents the raised rail 3 from sliding through the slide connectors 4.

A worker working in a valley 31 could attach a removable outrigger 16 to an adjustable outrigger plank support receptors 17. Another jack 5 may be installed perpendicular to the removable outrigger 16 and support plank 30. This is important because you do not have to install another roof jack in the valley 31. Once the structure is secured, either plank 5 can be set in the adjustable plank support 9. The adjustable plank support 9 can then be adjusted vertically by inserting the frame angle pin 12 into frame angle support 7. This adjustment compensates for the changing pitch of the roof 2. If the roof pitch is low, then the worker can place the frame angle pin 12 in a higher slot. If the roof pitch is higher, then the worker can place the frame angle pin 12 in a lower slot. The horizontal plank adjustment can be adjusted at the horizontal adjustment bar 28 which accounts for plank size by defined pin holes which match board dimensions. The safety post holders 8 are attached to the adjustable plank support 9, so they may work in combination with it. The safety post 13 can be set into the safety post holder 12, and safety rails 14 can be attached to the post 13. If a worker finishes tearing off the upper portion of the roof 2 under the upper raised rail 29, the worker may set a rail roof jack 5 in a preferred setting, corresponding with the upper raised rail 29. The rail roof jack 5, in the lower position could now be removed and the remaining roofing could be torn off, while the structure is still secured.

Once the roof 2 is clear of old materials, a roofer could install drip edge, ice shield, tar paper, shingles and wood under the raised rail 3, while working off the adjustable plank support 9. A worker would install shingles and a rail roof jack 5 under the rail and slide the slide connector 4, down onto the rail roof jack 5 and secure it. Once the lower rail roof jack 5 was installed, the upper rail roof jack 5 could again be installed and used for material storage and a working station. Once a roofer was finished working on a roof, he would take down the planks, rail roof jacks, post and rails.

A number of implementations have been described. Nevertheless, it will be understood that various modifications may be made without departing from the spirit and scope of the disclosure. Accordingly, other implementations are within the scope of the following claims.

What is claimed is:

1. A roof jack apparatus comprising:

a rail having first and second end portions;

a slide connector comprising:

a first tube slidably received over the rail when the rail is inserted through the first tube;

a handle pivotally coupled to the first tube, the handle having one end biased to engage the rail, wherein friction between the biased handle end and the rail impedes movement of the slide connector along the rail to fix a position of the slide connector along the rail; and a second tube connected to the first tube, the second tube configured to releasably receive an inserted head of a jack support for at least partially supporting the rail above a roof;

a fascia rest disposed on the second end portion of the rail for resting against a fascia of the roof, the slide connector movable along the rail with respect to the fascia rest; and a plank support disposed on the second end portion of the rail for receiving and supporting at least one plank.

2. The roof jack apparatus of claim 1, further comprising a slide stop having a slide stop body defining:

a rail receiver therethrough for receiving the rail; and a peg hole therethrough for receiving a peg, the peg hole alignable with a corresponding rail hole defined by the rail for receiving a peg in the aligned peg and rail holes to lock a position of the slide stop on the rail, the locked slide stop limiting travel of the slide connector along the rail.

3. The roof jack apparatus of claim 2, wherein the slide stop further comprises a standoff adjuster disposed on the slide stop body for adjusting an offset distance between the slide stop body and the slide connector on the rail, when the slide connector abuts the slide stop.

4. The roof jack apparatus of claim 3, wherein the standoff adjuster comprises a set screw threadably received by the slide stop body.

5. The roof jack apparatus of claim 1, wherein the slide connector comprises a connector body defining a rail receiver for receiving the rail therethrough and a jack support receiver for releasably receiving an arm of the jack support.

6. The roof jack apparatus of claim 1, wherein the jack support comprises a jack frame body having first and second ends, the first end defining at least one nail receiver for receiving a nail to secure the jack support to a roof, the second end configured to be received by the slide connector.

7. The roof jack apparatus of claim 6, wherein the jack frame body defines a plank support surface between the first and second ends of the jack frame body to support a received plank at an angle with respect to an attached roof.

8. The roof jack apparatus of claim 1, wherein the fascia rest comprises at least one extendable leg extending for engaging the roof fascia.

9. The roof jack apparatus of claim 1, further comprising:

a frame support disposed on the rail; and a plank support receiver disposed on the second end portion of the rail spaced apart from the frame support;

wherein the plank support has first and second end portions, the first end portion of the plank support is rotatably coupled to the frame support and the second end portion of the plank support is received by the plank support receiver, the plank support receiver limiting a range of rotation of the plank support.

10. The roof jack apparatus of claim 9, wherein the plank support receiver defines an array of holes which can receive a peg to set a rotation limit of the plank support.

11. The roof jack apparatus of claim 1, further comprising a railing support receiver disposed on the second end portion of the rail and defining a receptacle configured to receive a railing support.

12. The roof jack apparatus of claim 1, further comprising a plank fastener arranged near the plank support for holding one or more planks against the plank support.

13. A roof jack apparatus comprising:

a rail;

a slide stop defining an opening configured to receive the rail, the slide stop slidably disposed on and fixedly positionable along the rail;

a slide connector comprising:

a first tube slidably received over the rail when the rail is inserted through the first tube, the slide stop limiting travel of the slide connector along the rail when fixedly positioned on the rail;

a handle pivotally coupled to the first tube, the handle having one end biased to engage the rail, wherein friction between the biased handle end and the rail impedes movement of the slide connector along the rail to fix a position of the first tube; and a second tube connected to the first tube, the second tube configured to releasably receive an inserted head of a jack support for at least partially supporting the rail above the roof; and a support frame connected to the rail, the support frame comprising:

a frame support connected to the rail;

a fascia rest connected to the frame support; and a plank support connected to the frame support and the rail.

14. The roof jack apparatus of claim 13, wherein the slide stop comprises a slide stop body defining a rail receiver therethrough for receiving the rail and a peg hole therethrough for receiving a peg, the peg hole alignable with a corresponding rail hole defined by the rail for receiving a peg in the aligned peg and rail holes to lock a position of the slide stop on the rail.

15. The roof jack apparatus of claim 13, wherein the slide stop comprises a slide stop body and a standoff adjuster disposed on the slide stop body for adjusting an offset distance between the slide stop body and the abutting slide connector on the rail.

16. The roof jack apparatus of claim 15, wherein the standoff adjuster comprises a set screw threadably received by the slide stop body.

17. The roof jack apparatus of claim 13, wherein the slide connector comprises a connector body defining a rail receiver for receiving the rail therethrough and a jack support receiver for releasably receiving an arm of the jack support.

18. The roof jack apparatus of claim 13, wherein the jack frame comprises a jack frame body having first and second ends, the first end defining at least one nail receiver for receiving a nail to secure the support frame to a roof, the second end configured to be received by the slide connector.

19. The roof jack apparatus of claim 18, wherein the jack frame body defines a plank support surface between the first and second ends to support a received plank at an angle with respect to an attached roof

20. The roof jack apparatus of claim 13, wherein the fascia rest comprises at least one extendable leg extending at an angle with respect to the frame support for engaging a roof fascia.

21. The roof jack apparatus of claim 13, wherein the plank support has a first end portion rotatably coupled to the frame support and a second end portion received by a plank support receiver attached to the rail, the plank support receiver limiting a range of rotation of the plank support.

22. The roof jack apparatus of claim 21, wherein the plank support receiver defines an array of holes which can receive a peg to set a rotation limit of the plank support.

23. The roof jack apparatus of claim 13, wherein the support frame further comprises a railing support receiver defining a receptacle configured to receive a railing support.

24. The roof jack apparatus of claim 13, wherein the support frame further comprises a plank fastener for holding one or more planks against the plank support.

* * * * *